US008491681B2

(12) United States Patent
Chuda et al.

(10) Patent No.: US 8,491,681 B2
(45) Date of Patent: Jul. 23, 2013

(54) ABRASIVE PRODUCTS INCLUDING ACTIVE FILLERS

(75) Inventors: Katarzyna Chuda, Villejuif (FR); Jérôme Latournerie, Vaureal (FR); Patrick Garnier, Paris (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 304 days.

(21) Appl. No.: 12/284,616

(22) Filed: Sep. 23, 2008

(65) Prior Publication Data

US 2009/0077900 A1 Mar. 26, 2009

Related U.S. Application Data

(60) Provisional application No. 60/995,104, filed on Sep. 24, 2007, provisional application No. 61/124,708, filed on Apr. 17, 2008.

(51) Int. Cl.
*C09K 3/14* (2006.01)

(52) U.S. Cl.
USPC ..... 51/298; 51/307; 51/309; 451/28

(58) Field of Classification Search
None
See application file for complete search history.

(56) References Cited

U.S. PATENT DOCUMENTS 2,308,983 A 1/1943 Kistler
2,840,482 A * 6/1958 Knapp et al. ..... 428/433
3,030,198 A * 4/1962 Kibbey ..... 51/298
3,180,747 A * 4/1965 Cox et al. ..... 106/600
3,333,776 A * 8/1967 Rauner et al. ..... 241/22
3,401,013 A * 9/1968 Hans et al. ..... 423/301
3,505,372 A * 4/1970 Schenach et al. ..... 556/118

(Continued)

FOREIGN PATENT DOCUMENTS

CA 1023954 1/1978
DE 2410686 9/1975

(Continued)

OTHER PUBLICATIONS

Amita, K., et al., "The Mechanochemical Effects of Grinding on the Reaction Between $Bi_2O_3$ and CuO," *Nippon Kagaku Kaishi,* 10: 1438-1442 (Oct. 1991).

(Continued)

*Primary Examiner* — Kaj K Olsen
*Assistant Examiner* — Ross J Christie
(74) *Attorney, Agent, or Firm* — Joseph P. Sullivan; Abel Law Group, LLP

(57) ABSTRACT

An abrasive product comprises an abrasive component and a bond component. In one embodiment, the bond component includes a binder and a filler component that includes a cryolite and at least one member selected from the group consisting of sodium oxalate ($Na_2C_2O_4$), sodium borate ($Na_2B_4O_7.10H_2O$), sodium polyphosphate, opal glass, a hexafluoroferrate, and a hexafluorozirconate. In another embodiment, the bond component includes a binder and a filler component that includes at least one member selected from the group consisting of a hexafluoroferrate, and a hexafluorozirconate. Alternatively, an abrasive product comprises an abrasive component and a filler component that includes at least one member selected from the group a hexafluoroferrate and a hexafluorozirconate. The abrasive component includes at least one of abrasive particles and agglomerates of abrasive particles.

45 Claims, 2 Drawing Sheets

U.S. PATENT DOCUMENTS 3,634,311 A * 1/1972 Peterson et al. ..... 524/409
3,647,700 A * 3/1972 Phillips ..... 510/508
3,737,385 A * 6/1973 Werdehausen ..... 510/375
3,907,697 A * 9/1975 Burrous ..... 252/75
4,049,467 A * 9/1977 Rubin ..... 134/2
4,059,624 A * 11/1977 Harrison ..... 564/235
4,206,067 A * 6/1980 MacKinnon ..... 252/75
4,335,102 A * 6/1982 Nakashima et al. ..... 424/52
4,381,188 A 4/1983 Waizer et al.
4,500,325 A 2/1985 Huber et al.
4,532,124 A * 7/1985 Pearce ..... 424/52
4,543,107 A 9/1985 Rue
4,644,703 A 2/1987 Kaczmarek et al.
4,702,904 A * 10/1987 Maeyama et al. ..... 424/52
4,770,671 A 9/1988 Monroe et al.
4,773,920 A 9/1988 Chasman et al.
4,881,951 A 11/1989 Monroe et al.
4,898,597 A 2/1990 Hay et al.
4,903,440 A 2/1990 Larson et al.
4,910,924 A 3/1990 Holden et al.
4,927,431 A 5/1990 Buchanan et al.
5,011,512 A 4/1991 Wald et al.
5,014,468 A 5/1991 Ravipati et al.
5,025,723 A 6/1991 Abendroth et al.
5,039,311 A 8/1991 Bloecher
5,061,294 A * 10/1991 Harmer et al. ..... 51/295
5,078,753 A * 1/1992 Broberg et al. ..... 51/298
5,094,672 A 3/1992 Giles, Jr. et al.
5,095,665 A 3/1992 Nagata et al.
5,110,320 A * 5/1992 Broberg et al. ..... 51/295
5,110,321 A 5/1992 Broberg et al.
5,164,348 A 11/1992 Wood
5,178,646 A 1/1993 Barber et al.
5,185,012 A 2/1993 Kelly
5,203,886 A 4/1993 Sheldon et al.
5,213,591 A 5/1993 Celikkaya et al.
5,219,463 A * 6/1993 Broberg et al. ..... 51/295
5,236,472 A 8/1993 Kirk et al.
5,312,789 A 5/1994 Wood
5,314,513 A 5/1994 Miller et al.
5,352,254 A * 10/1994 Celikkaya ..... 51/295
5,368,618 A 11/1994 Masmar et al.
5,378,251 A 1/1995 Culler et al.
5,391,210 A 2/1995 Bikadi et al.
5,401,284 A 3/1995 Sheldon et al.
5,441,549 A 8/1995 Helmin
5,451,446 A 9/1995 Kincaid et al.
5,454,750 A 10/1995 Cosmano et al.
5,486,308 A 1/1996 Mayeaux
5,498,268 A 3/1996 Gagliardi
5,500,273 A 3/1996 Holmes et al.
5,507,850 A 4/1996 Helmin
5,520,711 A 5/1996 Helmin
5,536,283 A 7/1996 Sheldon et al.
5,549,719 A 8/1996 Lee et al.
5,549,962 A 8/1996 Holmes et al.
5,551,962 A 9/1996 Ho
5,554,664 A * 9/1996 Lamanna et al. ..... 522/25
5,556,437 A 9/1996 Lee et al.
5,562,745 A * 10/1996 Gagliardi et al. ..... 51/298
5,578,098 A * 11/1996 Gagliardi et al. ..... 51/295
5,593,303 A * 1/1997 Cohen et al. ..... 433/9
5,628,952 A 5/1997 Homes et al.
5,667,541 A 9/1997 Klun et al.
5,678,753 A 10/1997 Stauder
5,711,774 A 1/1998 Sheldon
5,714,259 A 2/1998 Holmes et al.
5,725,421 A * 3/1998 Goers et al. ..... 451/303
5,738,695 A * 4/1998 Harmer et al. ..... 51/295
5,776,668 A * 7/1998 Oltean et al. ..... 430/523
5,833,724 A 11/1998 Wei et al.
5,840,088 A 11/1998 Yang et al.
5,851,247 A 12/1998 Stoetzel
5,863,306 A 1/1999 Qi et al.
5,863,308 A 1/1999 Qi et al.
5,876,470 A 3/1999 Abrahamson
5,888,258 A 3/1999 Kaaber
5,915,436 A * 6/1999 Johnson et al. ..... 15/187
5,961,674 A * 10/1999 Gagliardi et al. ..... 51/295
6,039,775 A 3/2000 Ho et al.
6,051,646 A * 4/2000 Nass et al. ..... 51/294
6,140,388 A 10/2000 Nass et al.
6,183,346 B1 2/2001 Gagliardi
6,186,866 B1 2/2001 Gagliardi
6,217,413 B1 4/2001 Christianson
6,264,533 B1 7/2001 Kummeth et al.
6,299,508 B1 10/2001 Gagliardi et al.
6,312,315 B1 11/2001 Gagliardi
6,364,747 B1 4/2002 Gagliardi
6,435,958 B1 8/2002 Damgaard et al.
6,451,076 B1 9/2002 Nevoret et al.
6,458,753 B1 * 10/2002 Haylett ..... 510/384
6,465,076 B2 10/2002 Larson et al.
6,475,253 B2 * 11/2002 Culler et al. ..... 51/295
6,521,004 B1 2/2003 Culler et al.
6,609,963 B2 8/2003 Li et al.
6,620,214 B2 9/2003 McArdle et al.
6,679,758 B2 1/2004 Bright et al.
6,753,359 B2 6/2004 Thurber et al.
6,769,969 B1 * 8/2004 Duescher ..... 451/59
6,833,014 B2 12/2004 Welygan et al.
6,863,592 B2 3/2005 Lee et al.
7,235,114 B1 6/2007 Minick et al.
2002/0026752 A1 * 3/2002 Culler et al. ..... 51/298
2002/0066233 A1 6/2002 McArdle et al.
2002/0095871 A1 7/2002 McArdle et al.
2002/0142705 A1 * 10/2002 Sugiura ..... 451/41
2003/0166750 A1 * 9/2003 Koletar et al. ..... 524/113
2004/0018802 A1 1/2004 Welygan et al.
2005/0014732 A1 1/2005 Gulve et al.
2005/0032469 A1 * 2/2005 Duescher ..... 451/548
2005/0081455 A1 4/2005 Welygan et al.
2005/0085167 A1 4/2005 Swei et al.
2005/0118939 A1 * 6/2005 Duescher ..... 451/527

FOREIGN PATENT DOCUMENTS

EP 0 078 896 9/1982
EP 0070520 1/1983
EP 0 358 383 B1 3/1990
EP 0 370 658 B1 5/1990
EP 0 486 308 A2 5/1992
EP 0 500 369 A2 8/1992
EP 0 442 710 B1 7/1995
EP 0 444 824 B1 12/1995
EP 0 652 919 B1 2/1996
EP 0 228 856 B2 12/1996
EP 0 552 190 B1 12/1996
EP 0 750 539 B1 1/1997
EP 0 750 540 B1 1/1997
EP 0 480 586 B1 3/1997
EP 0 781 312 B1 7/1997
EP 0 696 945 B1 9/1997
EP 0 719 200 B1 12/1997
EP 0 293 163 B1 1/1998
EP 0 855 948 B1 8/1998
EP 0 961 670 B1 12/1999
EP 0 706 440 B1 4/2000
EP 1 007 599 B1 6/2000
EP 1 118 385 A1 7/2001
EP 1 011 924 B1 2/2002
EP 1 017 540 B1 6/2002
EP 1 102 660 B1 7/2002
EP 0 925 151 B1 7/2003
EP 1 342 537 B1 9/2003
EP 0 395 088 B2 12/2003
EP 0 954 411 B1 6/2004
EP 1 800 801 A2 6/2007
EP 1 808 089 A1 7/2007
EP 1 038 637 B1 1/2008
JP 2005 001108 A 1/2005
KR 100189173 B1 6/1999
KR 20070039101 A 4/2007
WO WO 92/05915 A1 4/1992
WO WO 92/06915 A1 4/1992
WO WO 93/17080 A1 9/1993
WO WO 93/17831 A1 9/1993
WO WO 93/17832 A1 9/1993

| | | | | |
|---|---|---|---|---|
| WO | WO 94/02561 | A1 | | 2/1994 |
| WO | WO 94/02562 | A1 | | 2/1994 |
| WO | WO 94/23898 | A1 | | 10/1994 |
| WO | WO 95/01241 | A1 | | 1/1995 |
| WO | WO 95/02499 | A1 | | 1/1995 |
| WO | WO 95/07796 | A1 | | 3/1995 |
| WO | WO 95/16547 | A1 | | 6/1995 |
| WO | WO 95/20469 | A1 | | 8/1995 |
| WO | WO 95/24991 | A1 | | 9/1995 |
| WO | WO 95/24992 | A1 | | 9/1995 |
| WO | WO 96/08542 | A1 | | 3/1996 |
| WO | WO 97/14535 | | | 4/1997 |
| WO | WO 98/10896 | A1 | | 3/1998 |
| WO | WO 98/30358 | A1 | | 7/1998 |
| WO | WO 98/30361 | A1 | | 7/1998 |
| WO | WO 98/36872 | A1 | | 8/1998 |
| WO | WO 99/06500 | A1 | | 2/1999 |
| WO | WO 99/08837 | A1 | | 2/1999 |
| WO | WO 99/12707 | A1 | | 3/1999 |
| WO | WO 99/22912 | A1 | | 5/1999 |
| WO | WO 9922912 | A1 | * | 5/1999 |
| WO | WO 99/56914 | A1 | | 11/1999 |
| WO | WO 00/07774 | A1 | | 2/2000 |
| WO | WO 00/07775 | A1 | | 2/2000 |
| WO | WO 00/07776 | A1 | | 2/2000 |
| WO | WO 01/43919 | A1 | | 6/2001 |
| WO | WO 02/28802 | A2 | | 4/2002 |
| WO | WO 02/32832 | A1 | | 4/2002 |
| WO | WO 02/33019 | A1 | | 4/2002 |
| WO | WO 02/062531 | A1 | | 8/2002 |
| WO | WO 2004/011196 | A1 | | 2/2004 |
| WO | WO 2004/048042 | A1 | | 6/2004 |
| WO | WO 2007/005452 | A1 | | 1/2007 |
| WO | WO 2007/078742 | A1 | | 7/2007 |
| WO | WO 2007/078914 | A1 | | 7/2007 |
| WO | WO 2007/079168 | A1 | | 7/2007 |

OTHER PUBLICATIONS

Masui, T., "Modification of Rare Earth Oxides for Applicable Functional Materials," *Kidorui,* 46: 120-121 (2005)(Month of Publication—not available).

Niizeki, S., et al., "Solid Lubricants for High Temperature Ceramic Rolling Bearings (Part 1)—Various Solid Lubricants Based on Fluoride Compounds," *Kikai Gijutsu Kenkyojo Shoho,* 49(3): 1-12 (1995)(Month of Publication—not available).

Procyk, B., et al., "Investigations of Wettability and Reactivity in Glass/Carbon and Glass/Ceramic Systems," *Trans. JWRI*, 30(Special Issue): 149-154 (2001)(Month of Publication—not available).

Sedano, A., et al., "Electrochemical Study of Copper and Bismuth Compounds in the Solid State by Using Voltammetry of Immobilized Microparticles: Application to $YBa_2Cu_3O_{7-x(s)}$ and $Bi_2Sr_2CaCu_2O_{8-x(s)}$ High Transition Temperature Superconductors," *J. Solid State Electrochem.,* 7:301-308 (2003)(Month of Publication—not available).

Kruschwitz, J., et al., "Optical and Durability Properties of Infrared Transmitting Thin Films," *Applied Optics*, 36(10): 2157-2159 (Apr. 1997).

Trontelj, M., et al., "Sintering of ZnO in the Presence of a Liquid Phase," *Science of Ceramics*, 9:127-134 (Nov. 1997).

Antipov, E.V., et al., "Electrochemical Behavior of Metals and Binary Alloys in Cryolite-Alumina Melts," Light Metals, pp. 403-408 (2006).

Cadwell, D.E., et al., "Grinding a Titanium Alloy with Coated Abrasives," ASME Paper 58-SA-44, Jun., 1958.

Cassayre, L., et al., "Anodic Dissolution of Metals in Oxide-Free Cryolite Melts, Journal of Applied Electrochemistry," 35(10), pp. 999-1004 (2005).

Djokić, S.S. and Conway, B.E., "Comparison of the Behavior of Glassy Carbon and Some Metals for Use as Nonconsumable Anodes in Alumina-Cryolite Melts.," Journal of Applied Electrochemistry, 25(2), pp. 106-113 (1995).

Hong, I.S., et al., "Coated Abrasive Machining of Titanium Alloys with Inorganic Phosphate Solutions," *ASLE Trans*., 14(1), pp. 8-11 (1971).

Jentoftsen, T.E., et al., "Solubility of Iron and Nickel Oxides in Cryolite-Alumina Melts," Light Metals, *TMS*, p. 455-461 (2001).

Jentoftsen, T.E., et al., "Solubility of Some Transition Metal Oxides in Cryolite-Alumina Melts: Part II. Solubility of $TiO_2$," Metallurgical and Materials Transactions B, 33B: 909-913 (2002).

Lai Yan-Qing, et al., "Preliminary Testing of $NiFe_20_4$-NiO-Ni Cermet as Inert Anode in $Na_3A1F_6$-$A1F_3$ Melts," Trans. Nonferrous Met. Soc. China, 16, pp. 654-658 (2006).

Lai Yan-Qing, et al., "Results from 100 h Electrolysis Testing of $NiFe_2O_4$-Based Cermet as Inert Anode in Aluminium Reduction," Trans. Nonferrous Met. Soc. China, 16, pp. 970-974 (2006).

Lorentsen, O.A., "Behaviour of Nickel, Iron, and Copper by Application of Inert Anodes in Aluminium Production," Norwegian University of Science and Technology, PhD Thesis, pp. 276 (2000).

PCT Application No. PCT/US2008/077372: Notification of Transmittal of the International Preliminary Report on Patentability dated Jan. 22, 2010.

PCT Application No. PCT/US2008/077372: Notification of Transmittal of the International Search Report and the Written Opinion of the International Searching Authority, or the Declaration dated Jan. 16, 2009.

Skybakmoen, E., et al., "Alumina Solubility in Molten Salt Systems of Interest for Aluminum Electrolysis and Related Phase Diagram Data, " Metallurgical and Materials, Transactions B, 28B: 81-86 (1997).

Sterten, A. and Skar, O., "Some Binary $Na_3A1F_6$-$M_xO_y$ Phase Diagrams," Aluminium, 64(10), 1051-4 (1988).

Rapp, R.A. and Zhang, Y., "Modeling of Equilibria in Complex Cryolite Melts, Monatshefte Fur Chemie," 136, pp. 1853-1860 (2005).

Zhang, Y., et al., "The Solubility of Titanium Dioxide in Cryolite-Alumina Melts at 1300 K," Metallurgical and Materials Transactions B, 35B: 182-186 (2004).

Chinese Application No. 200880106846.6: Notice on Publication and Entering into Substantive Examination Procedure of Application of Patent for Invention dated Aug. 25, 2010.

Chinese Application No. 200880106846.6: International Application Entering into the Chinese National Phase Notice on the Application Having Passed the Preliminary Examination dated Aug. 25, 2010.

Solheim, A. and Sterten, A., "Activity of Alumina in the System NaF-$A1F_3$-$A1_2O_3$ at NaF/$A1F_3$ Molar Ratios Ranging from 1.4 to 3," TMS Light Metals Committee at the 128th TMS Annual Meeting, San Diego, CA, 445-452 (1999).

* cited by examiner

ABRASIVE PRODUCTS INCLUDING ACTIVE FILLERS

RELATED APPLICATIONS

This application claims the benefit of U.S. Provisional Application No. 60/995,104, filed on Sep. 24, 2007 and U.S. Provisional Application No. 61/124,708, filed on Apr. 17, 2008.

The entire teachings of the above applications are incorporated herein by reference.

BACKGROUND OF THE INVENTION

Abrasive products commonly include one or more fillers, such as grinding aids, which can improve performance characteristics of abrasive products, such as cut rate, coolness of cut, product wear, and product life. Cryolite is one such filler, and is often employed to improve the performance of abrasive products, particularly abrasive products employed to grind stainless steels. However, under the Health, Safety and Environmental (HSE) regulations in the EU, special markings and hazardous waste disposal of any abrasive product having greater than three weight percent of cryolite are required.

Thus, there is a need for developing abrasive products employing an alternative to cryolite, or employing a relatively small amount of cryolite.

SUMMARY OF THE INVENTION

The present invention generally relates to abrasive products that include one or more non-cryolite fillers, and to methods of preparing such abrasive products.

In one embodiment, the present invention is directed to an abrasive product that comprises an abrasive component and a bond component. The abrasive component includes at least one of abrasive particles and agglomerates of abrasive particles. The bond component includes a binder and a filler component. The filler component includes a cryolite and at least one member selected from the group consisting of sodium oxalate ($Na_2C_2O_4$), sodium borate ($Na_2B_4O_7.10H_2O$), sodium polyphosphate, opal glass, a hexafluorophosphate, a hexafluoroferrate, a hexafluorozirconate and ammonium tetrafluoroborate In another embodiment, the present invention is directed to an abrasive product comprising an abrasive component and a filler component that includes at least one member selected from the group a hexafluoroferrate and a hexafluorozirconate. The abrasive component includes at least one of abrasive particles and agglomerates of abrasive particles.

In yet another embodiment, the present invention is directed to an abrasive product comprising an abrasive component and a bond component, the bond component including a binder and a filler component that includes at least one member selected from the group consisting of sodium oxalate ($Na_2C_2O_4$), sodium borate ($Na_2B_4O_7.10H_2O$), sodium polyphosphate, opal glass, a hexafluoroferrate, a hexafluorophosphate and a hexafluorozirconate. The abrasive component includes at least one of abrasive particles and agglomerates of abrasive particles In yet another embodiment, the present invention is directed to a method of preparing an abrasive product. In the method, an abrasive component that includes at least one of abrasive particles and agglomerates of abrasive particles is contacted with a bond component that includes a binder and a filler component. The bond component is cured to produce the abrasive product. In one aspect, the filler component includes a cryolite and at least one member selected from the group consisting of sodium oxalate ($Na_2C_2O_4$), sodium borate ($Na_2B_4O_7.10H_2O$), sodium polyphosphate, opal glass, a hexafluorophosphate, a hexafluoroferrate, a hexafluorozirconate and ammonium tetrafluoroborate. In another aspect, the filler component includes at least one member selected from the group consisting of a hexafluoroferrate, a hexafluorophosphate and a hexafluorozirconate.

In yet another embodiment, the present invention is directed to a method of preparing an abrasive product. In the method, a bond component that includes a binder and a filler component is formed. In one aspect, the filler component includes a cryolite and at least one member selected from the group consisting of sodium oxalate ($Na_2C_2O_4$), sodium borate ($Na_2B_4O_7.10H_2O$), sodium polyphosphate, opal glass, a hexafluorophosphate, a hexafluoroferrate, a hexafluorozirconate and ammonium tetrafluoroborate. In another aspect, the filler component includes at least one member selected from the group consisting of a hexafluoroferrate, a hexafluorophosphate and a hexafluorozirconate. A curable coating that includes the bond component is applied to an article including an abrasive component that includes at least one of abrasive particles and agglomerates of abrasive particles. The coating is then cured to thereby form the abrasive product.

The fillers that can be employed in the invention are relatively environmentally-friendly, e.g., relatively non-toxic and relatively non-harmful compared to cryolite. Also, grinding performances (e.g., metal removals) of the abrasive products of the invention employing one or more of the fillers can be comparable or are even better than abrasive products employing cryolite.

DETAILED DESCRIPTION OF THE INVENTION

Figure 1:
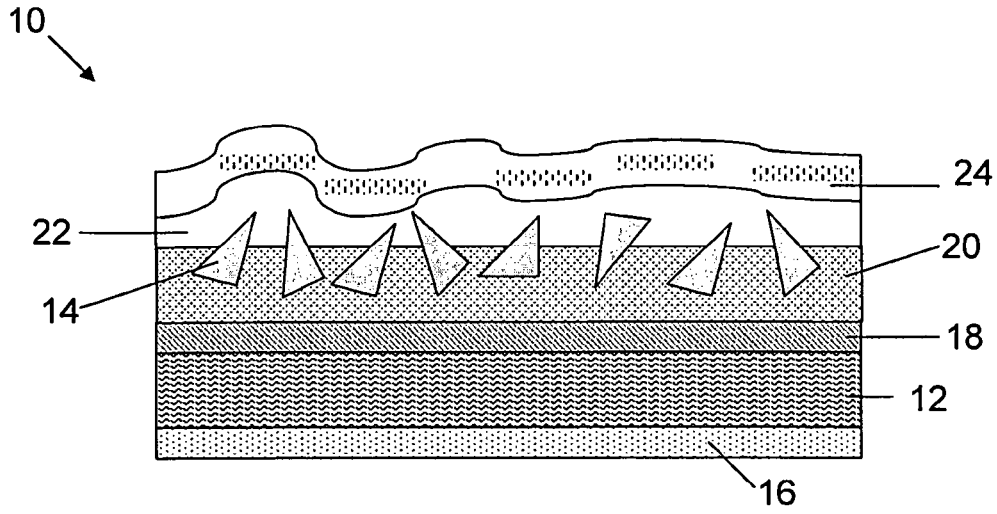
FIG. 1 is a schematic representation of a cross-sectional view of one embodiment of a coated abrasive product of the invention.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

In one embodiment, a filler component that can be employed in the invention includes a cryolite and at least one member selected from the group consisting of sodium oxalate ($Na_2C_2O_4$), sodium borate ($Na_2B_4O_7.10H_2O$), sodium polyphosphate, opal glass, a hexafluorophosphate, a hexafluoroferrate, a hexafluorozirconate and ammonium tetrafluoroborate ($(NH_4)BF_4$). Examples of hexafluorophosphates (salts of $PF_6^-$) include ammonium salt ($(NH_4)PF_6$), alkali metal salts (e.g., $LiPF_6$, $NaPF_6$, $KPF_6$, $CsPF_6$, etc.) and alkaline earth metal salts (e.g., $Mg(PF_6)_2$, $Ca(PF_6)_2$, $Sr(PF_6)_2$, $Ba(PF_6)_2$, etc.), and mixed salts thereof (e.g., ammonium and sodium salts, such as $(NH_4)Na(PF_6)_2$, ammonium and potassium salts, such as $(NH_4)K(PF_6)_2$, sodium and potassium salts, such as $NaK(PF_6)_2$, etc.). Specific examples of hexafluorophosphates include sodium hexafluorophosphate ($NaPF_6$) and potassium hexafluorophosphate ($KPF_6$), and combinations thereof. Examples of hexafluoroferrates (salts of $FeF_6^{3-}$) include ammonium salt ($(NH_4)_3FeF_6$), alkali metal salts (e.g., $Li_3FeF_6$, $Na_3FeF_6$, $K_3FeF_6$, $Cs_3FeF_6$, etc.) and alkaline earth metal salts (e.g., $Mg_3(FeF_6)_2$, $Ca_3(FeF_6)_2$, $Sr_3(FeF_6)_2$, $Ba_3(FeF_6)_2$, etc.), and mixed salts thereof (e.g., ammonium and sodium salts, such as $(NH_4)Na_2FeF_6$ and $(NH_4)_2NaFeF_6$, ammonium and potassium salts, such as $(NH_4)K_2FeF_6$ and $(NH_4)_2KFeF_6$, sodium and potassium salts, such as $K_2NaFeF_6$ and $KNa_2FeF_6$, calcium and sodium salts, such as $CaNaFeF_6$, calcium and potassium salts, such as $CaKFeF_6$, etc.). Specific examples of hexafluoroferrates include ammonium hexafluoroferrate ($(NH_4)_3FeF_6$) and alkali metal hexafluoroferrates, such as sodium hexafluoroferrate ($Na_3FeF_6$) and potassium hexafluoroferrate ($K_3FeF_6$), and combinations thereof. Examples of hexafluorozirconates (salts of $ZrF_6^{2-}$) include ammonium salt ($(NH_4)_2ZrF_6$), alkali metal salts (e.g., $Li_2ZrF_6$, $Na_2ZrF_6$, $K_2ZrF_6$, $Cs_2ZrF_6$, etc.) and alkaline earth metal salts (e.g., $MgZrF_6$, $CaZrF_6$, $SrZrF_6$, $BaZrF_6$, etc.), and mixed salts thereof (e.g., ammonium and sodium salts, such as $(NH_4)NaZrF_6$, ammonium and potassium salts, such as $(NH_4)KZrF_6$, sodium and potassium salts, such as $NaKZrF_6$, etc.). Specific examples of hexafluorozirconates include ammonium hexafluorozirconate ($(NH_4)_2ZrF_6$) and alkali metal hexafluorozirconates, such as sodium hexafluorozirconate ($Na_2ZrF_6$) and potassium hexafluorozirconate ($K_2ZrF_6$), and combinations thereof. In a specific embodiment, at least one of the hexafluorophosphate, the hexafluoroferrate and the hexafluorozirconate is an ammonium salt or a sodium salt. In yet another specific embodiment, the hexafluorophosphate is ammonium hexafluorophosphate, the hexafluoroferrate is sodium hexafluoroferrate, and the hexafluorozirconate is sodium hexafluorozirconate. In yet another specific embodiment, the filler component includes at least one member selected from the group consisting of ammonium hexafluorophosphate, sodium hexafluoroferrate, sodium hexafluorozirconate and ammonium tetrafluoroborate. In yet another specific embodiment, the filler component includes at least one member selected from the group consisting of ammonium hexafluorophosphate, sodium hexafluoroferrate and sodium hexafluorozirconate. In yet another specific embodiment, the filler component includes at least one member selected from the group consisting of sodium hexafluorozirconate and sodium hexafluoroferrate.

As used herein, a "cryolite" means a salt of aluminum hexafluoride ($AlF_6^{3-}$), such as an alkali metal salt, an alkaline earth metal salt, or an ammonium salt, or a combination thereof. Examples of cryolites include lithium aluminum hexafluoride ($Li_3AlF_6$), sodium aluminum hexafluoride ($Na_3AlF_6$), potassium aluminum hexafluoride ($K_3AlF_6$), ammonium aluminum hexafluoride ($(NH_4)_3AlF_6$), sodium ammonium hexafluoride (e.g., $K(NH_4)_2AlF_6$ or $K_2(NH_4)AlF_6$), potassium ammonium aluminum hexafluoride (e.g., $Na(NH_4)_2AlF_6$ or $Na_2(NH_4)AlF_6$), sodium potassium ammonium hexafluoride (i.e., $NaK(NH_4)AlF_6$), lithium ammonium aluminum hexafluoride (e.g. $Li(NH_4)_2AlF_6$ or $Li_2(NH_4)AlF_6$), etc. In one specific embodiment, sodium aluminum hexafluoride ($Na_3AlF_6$) is employed as a cryolite. The cryolite generally is present in an amount in a range of between about 2 wt % and about 98 wt %, such as between about 2 wt % and about 65 wt %, between about 2 wt % and about 50 wt %, of the filler component. In a specific embodiment, the amount of the cryolite is in a range between about 2 wt % and about 30 wt %, or between about 2 wt % and about 20 wt % of the filler component.

In another embodiment, the filler component that can be employed in the invention includes at least one member selected from the group consisting of a hexafluoroferrate, a hexafluorophosphate, a hexafluorozirconate and ammonium tetrafluoroborate. Suitable examples, including particular examples, of the hexafluoroferrate, the hexafluorophosphate and the hexafluorozirconate are as described above. In one specific embodiment, at least one of the hexafluoroferrate and the hexafluorozirconate is an ammonium salt or a sodium salt. In another specific embodiment, the filler component includes at least one member selected from the group consisting of a hexafluoroferrate and a hexafluorozirconate. In another specific embodiment, the filler component includes at least one member selected from the group consisting of sodium hexafluoroferrate and sodium hexafluorozirconate. Any suitable amount of the hexafluoroferrate, the hexafluorophosphate and the hexafluorozirconate can be employed in the invention.

In a specific embodiment, sodium oxalate ($Na_2C_2O_4$), sodium borate ($Na_2B_4O_7.10H_2O$), sodium polyphosphate, opal glass, the hexafluoroferrate, the hexafluorophosphate, the hexafluorozirconate and the ammonium tetrafluoroborate, disclosed herein, are each independently present in a range of between about 2 wt % and about 100 wt % of the filler component, such as between about 2 wt % and about 98 wt %, between about 35 wt % and about 98 wt % or between about 50 wt % and about 98 wt %, of the filler component. Alternatively, in an embodiment further employing a cryolite, sodium oxalate ($Na_2C_2O_4$), sodium borate ($Na_2B_4O_7.10H_2O$), sodium polyphosphate, opal glass, the hexafluoroferrate, the hexafluorophosphate, the hexafluorozirconate and the ammonium tetrafluoroborate are each independently present in a range of between about 2 wt % and about 98 wt % of the filler component, such as between about 35 wt % and about 98 wt % or between about 50 wt % and about 98 wt %, of the filler component.

In another specific embodiment, the filler component of the invention is present in an amount in a range between about 0.5 wt % and about 50 wt %, between about 10 wt % and about 50 wt %, between about 0.5 wt % and about 20 wt %, or between about 10 wt % and about 20 wt %, of the weight of the abrasive component.

In some embodiments, the filler component is incorporated into a bond component for abrasive products, such as coated abrasive products and bonded abrasive products. The bond component also includes a binder. Any suitable bond material known in the art can be used for the binder. The binder can be an inorganic binder or an organic binder. Suitable examples of organic binders include hide glue, urethane resins, acrylate resins, polyvinyl alcohols, epoxy resins, phenolic resins, urea-formaldehyde phenolic resins, aminoplast resins and mealmine-formaldehyde resins, and combinations thereof. Suitable examples of inorganic binders include cement, calcium oxide, clay, silica, magnesium oxide, and combinations thereof. Specific examples of suitable inorganic binders can be found in U.S. Pat. Nos. 4,543,107; 4,898,597; 5,203,886; 5,025,723; 5,401,284; 5,095,665; 5,536,283; 5,711,774; 5,863,308; and 5,094,672, the entire teachings of all of which are incorporated herein by reference. Specific binder(s) included in the bond component can be chosen depending upon particular application(s) of the bond component, for example, types of abrasive products and/or coats employing the bond component.

Abrasive particles or agglomerates of abrasive particles useful in the invention can be of any conventional abrasive material utilized in the formation of abrasive products. Examples of suitable abrasive materials for use in the invention include diamond, corundum, emery, garnet, chert, quartz, sandstone, chalcedony, flint, quartzite, silica, feldspar, pumice and talc, boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride. The abrasive materials can be oriented or can be applied to the substrate without orientation (i.e., randomly), depending upon the particular desired properties of the coated abrasive tools. In choosing an appropriate abrasive particles or agglomerates of abrasive particles, characteristics, such as size, hardness, compatibility with workpieces and heat conductivity, are generally considered. Abrasive particles or agglomerates of abrasive particles useful in the invention typically have a particle size ranging from about 0.1 micrometer and about 1,500 micrometers, such as from about 10 micrometers to about 1000 micrometers.

In some embodiments, the filler component disclosed herein is employed in forming agglomerates of abrasive particles. In a specific embodiment, the bond component includes the filler component in an amount in a range of between about 35 wt % and about 90 wt %, or between about 35 wt % and about 55 wt % (e.g., about 45 wt %), of the total agglomerate weight. Agglomerates of abrasive particles can be made by any suitable method known in the art, for example, in U.S. Pat. No. 6,217,413 and U.S. Pat. No. 6,679,758, the entire teachings of which are incorporated herein by reference). In one example, a mixture of a bond component and an abrasive particles can be added to a molding device, and the mixture is molded to form precise shapes and sizes, for example, in the manner disclosed in U.S. Pat. No. 6,217,413. In another example of the process useful herein for making agglomerates, a simple mixture, preferably a substantially homogeneous mixture, of abrasive particles and a bond component is fed into a rotary calcination apparatus (see, for example, U.S. Pat. No. 6,679,758). The mixture is tumbled at a predetermined revolution per minute (rpm) and along a predetermined incline, with the application of heat. Agglomerates are formed as the binder of the bond component heats, melts, flows and adheres to the abrasive particles. The firing and agglomeration steps are carried out simultaneously at controlled rates and volumes of feeding and heat application.

Suitable examples of the binders for the bond component for forming agglomerates of abrasive particles include ceramic materials, including silica, alkali, alkaline-earth, mixed alkali and alkaline-earth silicates, aluminum silicates, zirconium silicates, hydrated silicates, aluminates, oxides, nitrides, oxynitrides, carbides, oxycarbides and combinations and derivatives thereof. In general, ceramic materials differ from glassy or vitrified materials in that the ceramic materials comprise crystalline structures. Some glassy phases may be present in combination with the crystalline structures, particularly in ceramic materials in an unrefined state. Ceramic materials in a raw state, such as clays, cements and minerals, can be used herein. Generally, the binders are each independently used in powdered form and optionally, are added to a liquid vehicle to insure a uniform, homogeneous mixture of binders with abrasive particles during manufacture of the agglomerates. Although high temperature fusing binding materials are generally employed in the manufacture of the agglomerates, the bond component also can comprise other inorganic binders, organic binders, metal bond materials and combinations thereof. In one specific embodiment, the bond component is generally present at about 0.5 to about 15 volume %, about 1 to about 10 volume %, or about 2 to about 8 volume % of the agglomerate.

The filler components disclosed herein can be employed in forming abrasive products, such as coated abrasive products, bonded abrasive products and abrasive slurries. Generally, the bonded abrasive products are formed as a three-dimensional structure (e.g., a wheel) of abrasive particles and/or agglomerates thereof, bonded together via a bond component including a filler component disclosed herein. Generally, coated abrasive products comprises a base layer (or a substrate), an abrasive component that includes abrasive particles and/or agglomerates of abrasive particles, and one or more layers of a coat including a bond component disclosed herein. In one embodiment, the abrasive product includes an abrasive component that includes at least one of abrasive particles and agglomerates of abrasive particles, and a bond component. The bond component can be blended with an abrasive component or, in the alternative, applied prior to and/or after application of an abrasive component, and then cured to form a coat (e.g., a presize coat, a backsize coat, make coat, a size coat, or a supersize coat) of an abrasive product. After application of the bond component, either as a mixture with an abrasive component, or a coat (e.g., a presize coat, a backsize coat, make coat, a size coat, or a supersize coat), the bond component is cured under any suitable condition known in the art.

Figure 2:
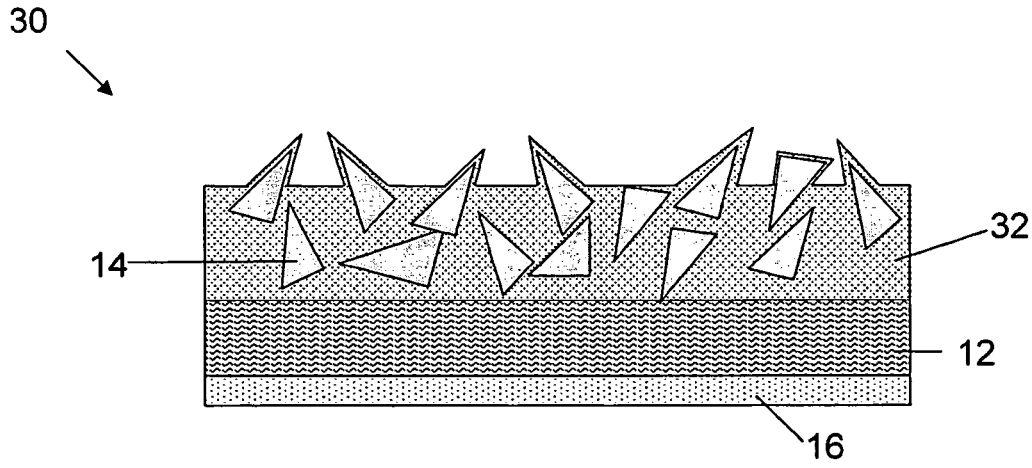
FIG. 2 is a schematic representation of a cross-sectional view of another embodiment of a coated abrasive product of the invention.

In one embodiment of an abrasive product of the invention, the abrasive product is a coated abrasive product that includes a base layer, an abrasive component, and a bond component that includes a filler component disclosed herein (e.g., see FIGS. 1 and 2). In one specific embodiment, the bond component is employed in a coat, such as a presize coat, make coat, size coat and/or supersize coat. Alternatively, the bond component is mixed with an abrasive component and forms an abrasive layer. Features, including preferred features, of the filler component are as described above.

The coated abrasive product of the invention generally include a substrate (i.e., base layer), an abrasive particles and at least one binder to hold the abrasive material to the substrate. As used herein, the term "coated abrasive product" encompasses a nonwoven abrasive product. FIGS. 1 and 2 show coated abrasive products 10 and 30 of the invention. Referring to FIG. 1, in coated abrasive product 10, substrate 12 is treated with optional backsize coat 16 and optional presize coat 18. Overlaying the optional presize coat 18 is make coat 20 to which abrasive component 14, such as abrasive particles and/or agglomerates thereof, are applied. Size coat 22 is optionally applied over make coat 20 and abrasive component 14. Overlaying size coat 22 is optional supersize coat 24. Depending upon their specific applications, coated abrasive product 10 may or may not include backsize coat 16 and/or presize coat 18. Also, depending upon their specific applications, coated abrasive product 10 may or may not include size coat 22 and/or supersize coat 24. Shown in FIG. 2 is coated abrasive product 30 that includes a layer of an abrasive material and binder(s) (abrasive layer 32) and optionally backsize coat 16. Optionally, presize coat 18, size coat 22 and supersize coat 24, as shown in FIG. 1, can be included in coated abrasive product 30.

In some embodiments, the filler component disclosed herein is employed in forming at least one coat selected from the group consisting of abrasive layer 32, backsize coat 16, presize coat 18, make coat 20, size coat 22 and supersize coat 24. In a specific embodiment, the filler component is employed in forming at least one coat selected from the group consisting of presize coat 18, make coat 20 and size coat 22. In another specific embodiment, the filler component is employed for affixing abrasive component 14 to substrate 12, for example, for forming abrasive layer 32 or at least one coat of coats 20 (make coat) and 22 (size coat). When the filler component is employed for forming abrasive layer 32, abrasive component 14 can be applied separately by gravity, electrostatic deposition or in air stream, or as slurry together with the filler component. In yet another specific embodiment, the filler component is used to form make coat 20 and/or size coat 22. The amount of the filler component of the bond component can vary depending upon the adhesive layer for which the bond component is employed. For example, for backsize coat 16, presize coat 18, or make coat 20, the amount of the filler component of the bond component is in a range of between about 5 wt % and about 70 wt %, between about 20 wt % and about 70 wt %, or between about 40 wt % and about 60 wt % (e.g., about 50 wt %) of the total weight of the coat. Alternatively, for size coat 22, the amount of the filler component of the bond component is in a range of between about 5 wt % and about 70 wt % (e.g., about 35 wt % or about 50 wt %), between about 20 wt % and about 70 wt %, or between about 30 wt % and about 60 wt %, between about 40 wt % and about 60 wt %, or between about 45 wt % and about 55 wt % (e.g., about 50 wt %), of the total weight of the size coat. Alternatively, for supersize coat 24, the amount of the filler component of the bond component is in a range of between about 30 wt % and about 90 wt %, between about 40 wt % and about 90 wt %, between about 50 wt % and about 90 wt %, between about 60 wt % and about 80 wt % (e.g., about 70 wt %), of the total weight of the supersize coat. Alternatively, for abrasive layer 32, backsize coat 16, presize coat 18, make coat 20, size coat 22 or supersize coat 24, the amount of the filler component of the bond component is in a range of between about 0.5 wt % and about 50 wt %, between about 10 wt % and about 50 wt %, between about 0.5 wt % and about 20 wt %, or between about 10 wt % and about 20 wt %, of the weight of the abrasive component.

Substrate 12 may be impregnated either with a resin-abrasive slurry or a resin binder without abrasive grains, depending upon the required aggressiveness of the finished coated abrasive products, as described above. Substrate 12 useful in the invention can be rigid, but generally is flexible. Substrate 12 can be paper, cloth, film, fiber, polymeric materials, nonwoven materials, vulcanized rubber or fiber, etc., or a combination of one or more of these materials, or treated versions thereof. The choice of the substrate material generally depends on the intended application of the coated abrasive tool to be formed. In a specific embodiment, substrate 12 is a nonwoven material. As used herein, "nonwoven" means a web of random or directional fibers held together mechanically, chemically, or physically, or any combination of these. Examples of nonwoven materials include fibers formed into a nonwoven web that provides as a three-dimensional integrated network structure. Any fibers known to be useful in nonwoven abrasive tools can be employed in the invention. Such fibers are generally formed from various polymers, including polyamides, polyesters, polypropylene, polyethylene and various copolymers thereof. Cotton, wool, blast fibers and various animal hairs can also be used for forming nonwoven fibers. In some applications, the nonwoven substrate can include a collection of loose fibers, to which abrasive component 14 are added to provide an abrasive web having abrasive component 14 throughout.

Depending upon which coat(s) or layer(s) the bond component, including a binder and the filler component disclosed herein, is utilized for, abrasive component 14 is applied over substrate 12 prior to, after and/or simultaneously with the application of the bond component to the substrate. Abrasive component 14 can be applied over substrate 12 by spraying (via gravity, electrostatic deposition or air stream) or coating with the curable resin composition. In a specific embodiment, abrasive component 14 is applied over substrate 12 simultaneously with the bond component. In one example of this embodiment, as shown in FIG. 2, the bond component and the abrasive component are mixed together to form a binder-abrasive composition slurry, and the slurry is applied over substrate 12 to form abrasive layer 32. In another specific embodiment, abrasive component 14 is applied over substrate 12 coated with a coat including the bond component. In one example of this embodiment, the coat is at least one of the backsize, presize and make coats. In yet another specific embodiment, abrasive component 14 is applied prior to the application of a coat including the bond component to substrate 12. In one example of this embodiment, the coat is at least one of the size and supersize coats.

The layer(s) or coat(s) of coated abrasive products 10 and 30 can be made by any suitable method generally known in the art. In one embodiment, optional backsize coat 16 and optional presize coat 18, not containing abrasive component 14, are coated on substrate 12 and cured by exposure to heat in order to impart sufficient strength to substrate 12 for further processing. Then, make coat 20 is applied to substrate 12 to secure abrasive particles 14 throughout substrate 12, and while the coat is still tacky, abrasive component 14 are applied over make coat 20. The make coat is subsequently cured so as to hold abrasive component 14 in place. Thereafter, size coat 22 is applied over substrate 12, and then cured. The primary function of size coat 22 generally is to anchor abrasive component 14 in place and allow them to abrade a workpiece without being pulled from the coated abrasive structure before their grinding capability has been exhausted. In another embodiment, a slurry of abrasive component 14 and a bond component disclosed herein, is applied over substrate 12, optionally on presize coat 18 over substrate 12, and then cured.

In some cases, supersize coat 24 is deposited over size coat 22. Supersize coat 24 can be deposited with or without a binder. Generally, the function of supersize coat 24 is to place on a surface of coated abrasive component 14 an additive that provides special characteristics, such as enhanced grinding capability, surface lubrication, anti-static properties or anti-loading properties. Examples of suitable lubricants for supersize coat 24 include lithium stearate. Examples of suitable anti-static agent include alkali metal sulfonates, tertiary amines and the like. Examples of suitable anti-loading agents include metal salts of fatty acids, for example, zinc stearate, calcium stearate and lithium stearate, sodium laurel sulfate and the like. Anionic organic surfactants can also be used effective anti-loading agents. A variety of examples of such anionic surfactants and antiloading compositions including such an anionic surfactant are described in U.S. Patent Application Publication No. 2005/0085167 A1, the entire teachings of which are incorporated herein by reference. Other examples of suitable anti-loading agents include inorganic anti-loading agents, such as metal silicates, silicas, metal sulfates. Examples of such inorganic anti-loading agents can be found in WO 02/062531, the entire teachings of which are incorporated herein by reference. Supersize coat 24 can also include a filler component disclosed herein.

In some specific embodiments, the coated abrasive product of the invention includes a nonwoven substrate, such as a nonwoven substrate made from an air-laid process which is well known in the art. The nonwoven substrate is impregnated with a coating slurry composition that includes a non-blocked urethane prepolymer and a polymeric polyol, as described above, and an abrasive material, such as fine abrasive particles. The uncured, impregnated nonwoven substrate is wound spirally to form a log. Alternatively, the uncured impregnated nonwoven substrate is cut into sheets and the sheets are stacked between two metal plates to form a slab. The log or slab is then heated to form the nonwoven abrasive tool. Optionally, the cured log or slab is converted into a final shape normally used for polishing, deburring, or finishing applications in the metal or wood industries.

Figure 3:
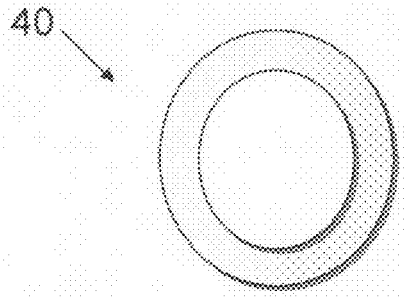
FIG. 3 is a schematic representation of a cross-sectional view of one embodiment of a bonded abrasive product of the invention.
Figure 4:
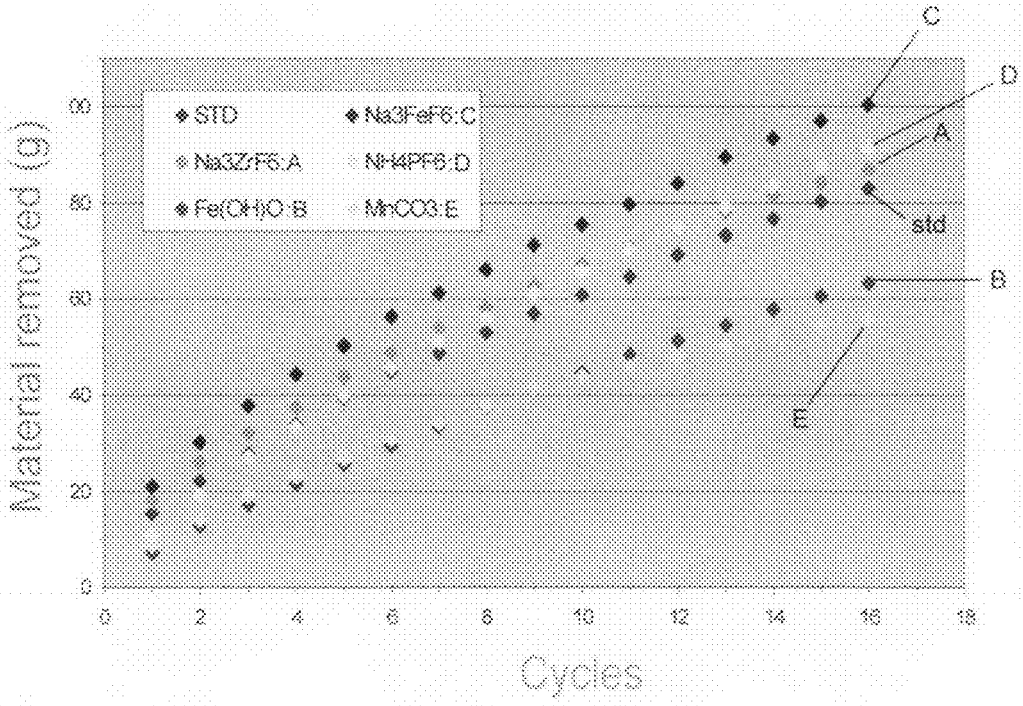
FIG. 4 is a graph showing removal of stainless steel using certain abrasive products of the invention that employ ammonium hexafluorophosphate, sodium hexafluorozirconate or sodium hexafluoroferrate, and using abrasive products that employ cryolite ("STD"), Fe(OH)O or $MnCO_3$ as controls.

In another embodiment of an abrasive product of the invention, the filler component is employed for forming a bonded abrasive product, such as bonded abrasive product 40 shown in FIG. 3. In the bonded abrasive product, the abrasive powders and/or agglomerates thereof are typically bonded together with the bond component. Features, including preferred features, of the filler component are as described above. In a specific embodiment, the amount of the filler component is in a range of between about 0.5 wt % and about 50 wt %, between about 10 wt % and about 50 wt %, between about 0.5 wt % and about 20 wt %, or between about 10 wt % and about 20 wt %, of the weight of the abrasive component of bonded abrasive product 40.

In one embodiment of the bonded abrasive products of the invention, the bond component including a filler component disclosed herein further includes an inorganic binder material selected from the group consisting of ceramic materials, vitrified materials, vitrified bond compositions and combinations thereof. Examples of suitable binders can be found in U.S. Pat. Nos. 4,543,107; 4,898,597; 5,203,886; 5,025,723; 5,401,284; 5,095,665; 5,711,774; 5,863,308; and 5,094,672. For example, suitable vitreous binders for the invention include conventional vitreous binders used for fused alumina or sol-gel alumina abrasive grains. Such binders are described in U.S. Pat. Nos. 5,203,886, 5,401,284 and 5,536,283. These vitreous binders can be fired at relatively low temperatures, e.g., about 850-1200° C. Other vitreous binders suitable for use in the invention may be fired at temperatures below about 875° C. Examples of these binders are disclosed in U.S. Pat. No. 5,863,308. The vitreous binders are contained in the compositions of the bonded abrasive products typically in an amount of less than about 28% by volume, such as between about 3 and about 25 volume %; between about 4 and about 20 volume %; and between about 5 and about 18.5 volume %.

Alternatively, an organic binder can be employed for forming the bonded abrasive products. Suitable examples of organic binders are as described above.

When an organic binder is employed, the combined blend of an abrasive component, and a bond component including an organic binder and a filler component described above is cured at a temperature, for example, in a range of between about 60° C. and about 300° C. to make the bonded abrasive product. When a vitreous binder is employed, the combined blend of an abrasive component, and a bond component including a vitreous binder and a filler component described above is fired at a temperature, for example, in a range of between about 600° C. and about 1350° C. to make the bonded abrasive product. Generally, the firing conditions are determined by the actual bond and abrasive components used. Firing can be performed in an inert atmosphere or in air. In some embodiments, the combined components are fired in an ambient air atmosphere. As used herein, the phrase "ambient air atmosphere," refers to air drawn from the environment without treatment.

Molding and pressing processes to form the bonded abrasive products, such as wheels, stones, hones and the like, can be performed by methods known in the art. For example, in U.S. Pat. No. 6,609,963, the entire teachings of which are incorporated herein by reference, teaches one such suitable method. Typically, the components are combined by mechanical blending. Optionally, the resulting mixture can be screened to remove agglomerates that may have formed during blending. The mixture is placed in an appropriate mold for pressing. Shaped plungers are usually employed to cap off the mixture. In one example, the combined components are molded and pressed in a shape suitable for a grinding wheel rim. Pressing can be by any suitable means, such as by cold pressing or by hot pressing, as described in U.S. Pat. No. 6,609,963. Molding and pressing methods that avoid crushing the hollow bodies are preferred. The pressing can be cold pressing or hot pressing. Cold pressing generally includes application, at room temperature, of an initial pressure sufficient to hold the mold assembly together. When hot pressing is employed, pressure is applied prior to, as well as during, firing. Alternatively, pressure can be applied to the mold assembly after an article is removed from a furnace, which is referred to as "hot coining." The abrasive article is removed from the mold and air-cooled. In a later step, the fired abrasive products can be edged and finished according to standard practice, and then speed-tested prior to use.

In the invention, optionally, the bond component, including a binder and a filler component, disclosed herein, can further include one or more additives, such as fillers other than the fillers described above (i.e., sodium oxalate ($Na_2C_2O_4$), sodium borate ($Na_2B_4O_7.10H_2O$), sodium polyphosphate, opal glass, hexafluorophosphates, hexafluoroferrate, hexafluorozirconates and ammonium tetrafluoroborate), coupling agents, fibers, lubricants, surfactants, pigments, dyes, wetting agents, anti-loading agents, anti-static agents and suspending agents. Examples of fillers include graphite, silicon fluoride, calcium metalsilicate, fiberglass fibers, glass bubbles, sodium hexafluorosilicate, potassium hexafluorosilicate, sulfates (e.g., sodium sulfate), aluminum hydroxide and silicates. Examples of the lubricants, anti-loading agents, and anti-static agents are as described above. Specific additive(s) that is included in the bond component can be chosen depending upon for which adhesive layer(s) (e.g., coats 16, 18, 20, 22, 24 and 32 of FIGS. 1 and 2, or a composition of a binder and an abrasive component, as shown in FIG. 3) the bond component is utilized. The amounts of these materials are selected, depending upon desired properties to achieve.

The abrasive products of the invention can generally take the form of sheets, discs, belts, bands, and the like, which can be further adapted to be mounted on pulleys, wheels, or drums. The abrasive products of the invention can be used for sanding, grinding or polishing various surfaces of, for example, steel and other metals, wood, wood-like laminates, plastics, fiberglass, leather or ceramics. In one embodiment, the abrasive products of the invention are used for abrading a work surface by applying the abrasive product in an abrading motion to remove a portion of the work surface.

EXEMPLIFICATION

Example 1

Characterization of Selected Fillers

A. Solubility and Toxicity Data of Fillers

Solubility and toxicity data of cryolite, ammonium hexafluorophosphate, ammonium tetrafluoroborate, sodium hexfluoroferrate, sodium hexafluorozirconate and sodium hexafluorophosphate, obtained from a mineralogist database (webmineral.com) are summarized in Table 1 below. As shown in Table 1, ammonium hexafluorophosphate, ammonium tetrafluoroborate, sodium hexfluoroferrate, sodium hexafluoro zirconate and sodium hexafluorophosphate are relatively less toxic than cryolite.

TABLE 1

Solubility and Toxicity Data of Fillers

| Fillers | Toxicity Classification[a] | Water Solubility |
|---|---|---|
| Cryolite | Hazard symbols: T<br>Risk phrases: 20/22-48/23/25-51/53 | 0.025 mg/L in water @ 20° C. |
| Ammonium Hexafluorophosphate | Hazard symbols: N<br>Risk phrases: R34 | soluble in water (50 mg/mL @ 20° C.) |
| Ammonium Tetrafluoroborate, | Risk phrases: R20/21, 36/37/38 | cold water soluble |
| Sodium Hexfluoroferrate | Not dangerous, no hazard symbols | not water soluble |
| Sodium Hexafluorozirconate | No hazard symbols<br>Risk phrases: R31 | not water soluble |
| Sodium Hexafluorophosphate | Hazard symbols: N<br>Risk phrases: R20/21/22-34 | water soluble @ 20° C. |

B. Characterization of Fillers Behavior During Stirring with Resin

In this example, any effect of the fillers, ammonium hexafluorophosphate, ammonium tetrafluoroborate, sodium hexfluoroferrate, sodium hexafluoro zirconate and sodium hexafluorophosphate, on mixing behaviour and/or rheology during mixing and curing abrasive blends. The evolution of viscosity of each blend (resin+filler) was checked just after mixing and during dilution with water. No significant effect of the fillers were observed; the viscosities of the blends were stable after mixing and during dilution.

Example 2

Performance Tests on Stainless Steel

A. Comparative Abrasive Paper Employing Cryolite i. Production of Abrasive Paper A vulcanised fiber (1000 g/m$^2$) was used as substrate. The make formulation was composed of the phenolic resin (53 wt % of Bakelite resin), and calcium carbonate (47 wt %) was applied to the latex coated paper at a wet-coat thickness of 60 μm (160 g/m$^2$) by means of a film application apparatus. Ceramic $Al_2O_3$ grains (ref. Cerpass from Saint-Gobain) were sprinkled by electrodeposition on the wet-binder film (270 g/m$^2$) and dried.

ii. Size Coat Preparation

A size coat was prepared by adding:

- 25 wt % of phenolic resin (resole ref. PERACIT 5030A from Dynea Resins France SAS),
- 25 wt % of phenolic resin (resole ref. PERACIT 5161A from Dynea Resins France SAS),
- 3 wt % of pigment (ref. BLEU 60293) from S.A. Richard,
- 1.5 wt % of dispersant (ref. 713K) from Rohm and Haas France,
- 40 wt % of synthetic cryolite from Solvay,
- 10 wt % of calcium carbonate (ref. OMYA BL 200-OG) from OMYA S.A.S.

iii. Abrasive Preparation

The obtained abrasive paper samples (example 2,A,i) were cut into round disks at an external diameter of 178 mm and an internal diameter of 22 mm and recovered by the binder (example 2,A,ii) with the brush to obtain 550 g of binder per square meter of abrasive. The excess was removed, and abrasives were dried 10 hours at 115° C.

iv. Performance Tests

These test samples were attached to a conventional grinding machine (SG Abrasives, Conflans). The grinding of stainless steel was realised at constant pressure of 6 kg during 16 min (16 cycles of 1 minute) with a plate which operated at 1200 r/min. The amount of steel cut off accounted for about 12 g. Certain test values are summarized in Table 6 below.

B. Abrasive Paper Employing Non-Cryolite Fillers

The same materials as described above in Example 2A served as a substrate and abrasive materials. Size coats were prepared by adding:

- 25 wt % of phenolic resin (resole ref. PERACIT 5030A from Dynea Resins France SAS),
- 25 wt % of phenolic resin (resole ref. PERACIT 5161A from Dynea Resins France SAS),
- 3 wt % of pigment (ref. BLEU 60293) from S.A. Richard,
- 1.5 wt % of dispersant (ref. 713K) from Rohm and Haas France,
- 40 wt % of $Na_3FeF_6$ (from Aldrich), or $Na_2ZrF_6$ (from Aldrich) or $NH_4PF_6$ (from Aldrich). For comparative example: 40 wt % of Fe(OH)O or $MnCO_3$, both from Aldrich.
- 10 wt % of calcium carbonate (ref. OMYA BL 200-OG) from OMYA S.A.S.

Performance Tests:

Performance tests were carried out as described above in Example 2A. The test results are summarized in Table 6 below and in FIG. 5. The weight loss of abrasives indicates the real loss of abrasives in grams. The relative cut indicates relative cut based on cryolite fixed to be 100%.

TABLE 6

Metal Removals of Abrasive Products of the Invention

| | Wt loss of Abrasives (g) | | Average Wt Loss of Abrasives (g) | Cut (g) | | Average cut (g) | Relative Cut (%) |
|---|---|---|---|---|---|---|---|
| Cryolite | 1.9 | 2.5 | 2.2 | 81.8 | 84.4 | 83.1 | 100.0 |
| | 1.9 | 1.5 | 1.7 | | | | |
| $Na_3FeF_6$ | 2.4 | 2.2 | 2.3 | 110.6 | 90.1 | 100.4 | 120.8 |
| $Na_2ZrF_6$ | 1.9 | 2.5 | 2.2 | 96.9 | 77.2 | 87.1 | 104.8 |
| $NH_4PF_6$ | 3.3 | 3.5 | 3.4 | 100.3 | 88.7 | 94.5 | 113.7 |

As shown in Table 6, the grinding performance in terms of metal removal of the abrasive products employing $Na_3FeF_6$, $Na_2ZrF_6$ or $NH_4PF_6$ were comparable to, or were even better than, that of the control abrasive product employing cryolite. Also, as shown in FIG. 5, the amounts of steel cut with the abrasive products employing $Na_3FeF_6$, $Na_2ZrF_6$ or $NH_4PF_6$ as fillers were greater than that with the control abrasive product employing cryolite, by about 19%, 8% and 4%, respectively. Comparative grinding with Fe(OH)O and $MnCO_3$ gave poor performance in terms of cutting (about 20% inferior compared to cryolite based abrasives) among the tested abrasive papers.

EQUIVALENTS

While this invention has been particularly shown and described with references to example embodiments thereof, it will be understood by those skilled in the art that various changes in form and details may be made therein without departing from the scope of the invention encompassed by the appended claims.

What is claimed is:

1. An abrasive product comprising a) an abrasive component that includes at least one of abrasive particles and agglomerates of abrasive particles; and b) a bond component that includes a binder and a filler component, the filler component including a cryolite and at least one member selected from the group consisting of sodium hexafluoroferrate and sodium hexafluorozirconate.

2. The abrasive product of claim 1, wherein the cryolite is present in an amount in a range of between about 2 weight % and about 98 weight % of the filler component.

3. The abrasive product of claim 2, wherein the cryolite is present in an amount in a range of between about 2 weight % and about 65 weight % of the filler component.

4. The abrasive product of claim 3, wherein the cryolite is present in an amount in a range of between about 2 weight % and about 50 weight % of the filler component.

5. The abrasive product of claim 1, wherein the filler component is present in an amount in a range of between about 0.5 weight % and about 50 weight % of the weight of the abrasive component.

6. The abrasive product of claim 1, wherein the abrasive product is a bonded abrasive product.

7. The abrasive product of claim 1, wherein the abrasive product is a coated abrasive product.

8. The abrasive product of claim 7, wherein the abrasive component includes agglomerates of abrasive particles.

9. The abrasive product of claim 8, wherein the bond component is a component of the agglomerates.

10. The abrasive product of claim 9, wherein the bond component includes the filler component in an amount in a range of between about 35 weight % and about 90 weight % of the total agglomerate weight.

11. The abrasive product of claim 10, wherein the amount of the filler component is in a range of between about 35 weight % and about 55 weight % of the total agglomerate weight.

12. The abrasive product of claim 11, wherein the amount of the filler component is about 45 weight % of the total agglomerate weight.

13. The abrasive product of claim 7, wherein the coated abrasive product includes an abrasive layer that includes the abrasive particles or the agglomerates of abrasive particles.

14. The abrasive product of claim 13, wherein the bond component is at least a component of the abrasive layer.

15. The abrasive product of claim 13, wherein the coated abrasive product includes a make coat, and the bond component is at least a component of the make coat.

16. The abrasive product of claim 15, wherein the bond component includes the filler component in an amount in a range of between about 5 weight % and about 70 weight % of the total weight of the make coat.

17. The abrasive product of claim 13, wherein the coated abrasive product includes a size coat, and the bond component is at least a component of the size coat.

18. The abrasive product of claim 17, wherein the bond component includes the filler component in an amount in a range of between about 5 weight % and about 70 weight % of the total weight of the size coat.

19. The abrasive product of claim 18, wherein the amount of the filler component is between about 25 weight % and about 65 weight % of the total weight of the size coat.

20. The abrasive product of claim 13, wherein the coated abrasive product includes a supersize coat, and the bond component is at least a component of the supersize coat.

21. The abrasive product of claim 20, wherein the filler component of the bond component is present in an amount in a range of between about 30 weight % and about 90 weight % of the total weight of the supersize coat.

22. The abrasive product of claim 21, wherein the amount of the filler component is between about 50 weight % and about 90 weight % of the total weight of the supersize coat.

23. An abrasive product, comprising an abrasive component and a filler component that includes a cryolite and at least one member selected from the group consisting of sodium hexafluoroferrate and sodium hexafluorozirconate.

24. The abrasive product of claim 23, wherein the filler component is present in an amount in a range of between about 0.5 weight % and about 50 weight % of the weight of the abrasive component.

25. The abrasive product of claim 24, wherein the at least one of the sodium hexafluoroferrate and the sodium hexafluorozirconate is present in a range of between about 2 weight % and about 98 weight % of the filler component.

26. The abrasive product of claim 23, wherein the abrasive product is selected from the group consisting of a coated abrasive product and a bonded abrasive product.

27. The abrasive product of claim 23, wherein the cryolite is present in a range of between about 2 weight % and about 98 weight % of the total weight of the filler component.

28. The abrasive product of claim 27, wherein the cryolite is present in an amount in a range of between about 2 weight % and about 65 weight % of the filler component.

29. The abrasive product of claim 28, wherein the cryolite is present in an amount in a range of between about 2 weight % and about 50 weight % of the filler component.

30. An abrasive product, comprising:

a) an abrasive component that includes at least one of abrasive particles and agglomerates of abrasive particles; and b) a bond component that includes a binder and a filler component that includes sodium hexafluoroferrate.

31. The abrasive product of claim 30, wherein the filler component is present in an amount in a range of between about 0.5 weight % and about 50 weight % of the weight of the abrasive component.

32. The abrasive product of claim 31, wherein the sodium hexafluoroferrate is present in a range of between about 2 weight % and about 100 weight % of the filler component.

33. The abrasive product of claim 30, wherein the abrasive product is selected from the group consisting of a coated abrasive product and a bonded abrasive product.

34. The abrasive product of claim 33, wherein the filler component further includes a cryolite.

35. The abrasive product of claim 34, wherein the cryolite is present in a range of between about 2 weight % and about 98 weight % of the total weight of the filler component.

36. The abrasive product of claim 35, wherein the cryolite is present in an amount in a range of between about 2 weight % and about 65 weight % of the filler component.

37. The abrasive product of claim 36, wherein the cryolite is present in an amount in a range of between about 2 weight % and about 50 weight % of the filler component.

38. A method of preparing an abrasive product, comprising the steps of:

a) contacting an abrasive component with a bond component that includes a binder and a filler component, the abrasive component including at least one of abrasive particles and agglomerates of abrasive particles, the filler component including a cryolite and at least one member selected from the group consisting of sodium hexafluoroferrate and sodium hexafluorozirconate; and b) curing the bond component to produce the abrasive product.

39. A method of preparing an abrasive product, comprising the steps of:

a) contacting an abrasive component with a bond component that includes a binder and a filler component, the abrasive component including at least one of abrasive particles and agglomerates of abrasive particles, the filler component including sodium hexafluoroferrate; and b) curing the bond component to produce the abrasive product.

40. A method of preparing an abrasive product, comprising the steps of:

a) forming a bond component that includes a binder and a filler component, the filler component including a cryolite and at least one member selected from the group consisting of sodium hexafluoroferrate and sodium hexafluorozirconate;

b) applying a curable coating that includes the bond component to an article including an abrasive component that includes at least one of abrasive particles and agglomerates of abrasive particles; and c) curing the coating, to thereby form the abrasive product.

41. A method of preparing an abrasive product, comprising the steps of:

a) forming a bond component that includes a binder and a filler component, the filler component including sodium hexafluoroferrate;

b) applying a curable coating that includes the bond component to an article including an abrasive component that includes at least one of abrasive particles and agglomerates of abrasive particles; and c) curing the coating, to thereby form the abrasive product.

42. A method for abrading a work surface comprising applying an abrasive product in an abrading motion to remove a portion of the work surface, the abrasive product including an abrasive component that includes at least one of abrasive particles and agglomerates of abrasive particles; and a bond component that includes a binder and a filler component, the filler component including a cryolite and at least one member selected from the group consisting of sodium hexafluoroferrate and sodium hexafluorozirconate.

43. A method for abrading a work surface comprising applying an abrasive product in an abrading motion to remove a portion of the work surface, the abrasive product including an abrasive component that includes at least one of abrasive particles and agglomerates of abrasive particles; and a bond component that includes a binder and a filler component that includes sodium hexafluoroferrate.

44. The abrasive product of claim 1, wherein the filler component includes cryolite and sodium hexafluoroferrate.

45. An abrasive product comprising an abrasive component and a filler component that includes sodium hexafluoroferrate.

* * * * *